United States Patent [19]

Hamar et al.

[11] Patent Number: 5,020,286

[45] Date of Patent: Jun. 4, 1991

[54] PORTABLE SECTIONAL FLOORING SYSTEM WITH POST SUPPORT

[75] Inventors: Douglas J. Hamar, Chassell; Gopal Jayaraman, Houghton; Richard Granroth, Laurium; Robert L. Whipple, South Range; Harold A. Evensen, Houghton, all of Mich.

[73] Assignee: Portage Holding, Inc., Mich.

[21] Appl. No.: 228,744

[22] Filed: Aug. 5, 1988

[51] Int. Cl.[5] ..... E04C 1/10; E02D 5/80

[52] U.S. Cl. ..... 52/585; 248/501; 52/298; 52/704; 272/3

[58] Field of Search ..... 52/298, 263, 585, 480; 273/29 BB; 272/3; 403/292, 298, 349; 248/500, 507, 508, 519, 292, 297, 704, 708, 582

[56] References Cited

U.S. PATENT DOCUMENTS

| | | | |
|---|---|---|---|
| 2,210,441 | 8/1940 | Bachman | 52/298 X |
| 3,876,199 | 4/1975 | Eichenauer | 403/349 X |
| 3,982,758 | 9/1976 | Howes, Jr. | 272/3 X |
| 4,059,934 | 11/1977 | Hayamizu | 52/298 X |
| 4,240,766 | 12/1980 | Smith et al. | 52/298 X |
| 4,296,574 | 10/1981 | Stephens | 52/263 X |
| 4,454,694 | 6/1984 | Davanture | 52/585 X |
| 4,538,392 | 9/1985 | Hamar et al. | 403/405.1 X |

FOREIGN PATENT DOCUMENTS

| | | | |
|---|---|---|---|
| 352649 | 3/1961 | Switzerland | 52/298 |

OTHER PUBLICATIONS

Pro King Portable Basketball Floor Specifications, Horner Flooring Company, Dollar Bay, Mich.

Pro King Portable Basketball Floor brochure, Horner Flooring Company, Dollar Bay, Mich.

*Primary Examiner*—David A. Scherbel

*Assistant Examiner*—M. Van Patten

*Attorney, Agent, or Firm*—Banner, Birch, McKie & Beckett

[57] ABSTRACT

A floor section assembly having a post anchor built into one of the floor panels for use with portable sectionalized flooring suitable for a volleyball court or the like is disclosed. The post anchor includes a base assembly attached to the undersurface of one of the panels and is coupled to a plurality of adjacent panels by tubes attached to the undersurface of the panels and coupled together by a rigid member extending through aligned tubes. This structure provides a broad base of support for the post carrying a volleyball net which can absorb moments placed on the post without the need for connecting the post to the base on which the flooring is assembled.

32 Claims, 3 Drawing Sheets

PORTABLE SECTIONAL FLOORING SYSTEM WITH POST SUPPORT

TECHNICAL FIELD

This invention relates to the flooring art and more particularly to a portable floor section having a built-in post anchor for use with portable sectionalized flooring suitable for a volleyball court or other flooring requiring post support.

BACKGROUND OF THE INVENTION

Special flooring systems for indoor and outdoor sports activities, dancing and other like uses have been proposed in the prior art. Among the drawbacks of many prior art floors are their high initial cost, permanency of installation and the fact that they must be made and installed at the flooring site rather than being fabricated and carried to the desired assembly location.

Furthermore, there are many environments and applications where permanent installation of a sports activity type of floor is not dictated or justified. Some locations may require that the sports activity type flooring be removable such that the locations is susceptible to utilization for purposes other than sports activities or for a variety of sports activities. Portable sectionalized flooring such as that disclosed in U.S. Pat. No. 4,538,392 have been used to provide this adaptability.

However, floors suitable for sports activities such as volleyball or the like present special problems in requiring post anchors to firmly support posts which in turn support a net. The post anchors should be capable of countering the moment developed by the net through each post so that the vertically upright position of each post remains true.

The problems in meeting these flooring anchor requirements are exacerbated when attempts have been made to associate such anchors with floors in a portable and/or sectionalized form of construction. Prior art attempts to achieve anchor stability require securing an anchor base to the permanent flooring beneath the portable sectionalized flooring system. A further problem is that the anchor base must be aligned with the volleyball center line. Consequently, the prior art installation requires laying portable floor panels after drilling anchor base holes into the permanent subflooring so that the anchor base can be aligned with the volleyball center line of the portable sectionalized flooring. Such a prior art system also calls for building a dummy panel to fit over the installed anchor base to assist in the designing of a sectionalized flooring panel so that the volleyball net post may pass through the sectionalized flooring panel and into the anchor base. Among the drawbacks of such a prior art system are high installation costs, increased set up time, necessary fabrication at the flooring site and difficulty in repositioning the volleyball net since new holes would have to be drilled into the subflooring. Furthermore, where these prior art sectionalized floors must be repeatedly put down and taken up before and after successive sports activities, the separate parts required for the assembly of such volleyball post anchor systems may be easily lost or misplaced while the floor sections are in their disassembled state of non-use or in storage.

SUMMARY OF THE INVENTION

In view of the above and other deficiencies of the known prior art, it is the aim of this invention to provide a prefabricated floor section having a post anchor built therein for use with portable sectionalized flooring suitable for a volleyball court or the like which can be quickly assembled and installed in a variety of environments, and which does not require connection of the post or its support base to the subfloor.

Thus, the invention involves a first floor section having a post anchor base built therein and secured to the undersurface thereof. Floor sections to be installed adjacent to the first floor section have stabilizing base extensions, in the form of pairs of hollow tubes, secured to their respective undersurfaces. The anchor base and base extensions have securing mechanisms, in the form of an elongated rigid member passing through aligned hollow tubes, for coupling the base extensions on adjacent floor sections to one another. When these floor sections are assembled, the base extends well beyond the first floor section thereby providing the requisite post anchor stability without securing the post anchor to the flooring beneath the portable sectionalized flooring.

It is an object of the present invention to provide portable sectionalized flooring suitable for a volleyball court or the like with pre-fabricated post anchors built therein to enable fast set-up time for any game.

It is another object of the present invention to provide a fully portable volleyball floor with built in post anchors to enable quick and simple disassembly and storage.

It is a further object of the present invention to provide a fully portable volleyball floor with post anchors not requiring any permanent anchor structure in the subfloor or drilling of post anchor holes in the subfloor, thereby reducing installation costs.

It is yet another object of this invention to provide portable sectionalized flooring having panels with built in post anchors thereby eliminating the problems of aligning the panel post hole with the anchor base hole or aligning the anchor base post hole with the volleyball court center line.

It is still a further object of the present invention to provide a volleyball post anchor base assembly and post therefore in an apparatus or kit form, for readily converting or adapting an existing portable sectionalized flooring for use as a volleyball court or the like with all of the advantages enumerated above.

Other important features and advantages of the invention will be apparent from the following description and the accompanying drawings, wherein for purposes of illustration only, a specific form of the invention is set forth in detail.

DETAILED DESCRIPTION OF THE INVENTION

Figure 1:
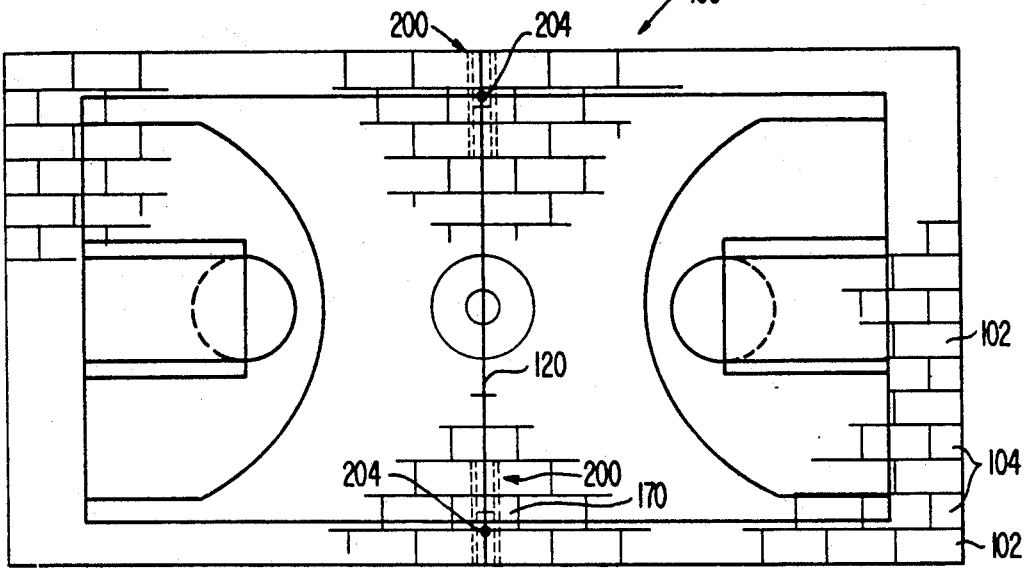
FIG. 1 is a plan view of an assembled sectionalized flooring system in accordance with the invention displaying appropriate markings for a basketball court and the post anchor base in phantom along the court center line.

FIG. 1 depicts an overall plan view of a completed sectionalized flooring system 100 and with two post anchor base assemblies 200 shown in phantom. Each post anchor base assembly and post support 204 thereof is aligned along center line 120. As shown in FIG. 1, planar flooring system 100 is appropriately marked to provide the playing surface for a basketball court. However, it should be understood that post anchor base assembly 200 may be used with any portable sectionalized flooring suitable for volleyball or the like, and that such use is not limited, for example, to the playing surface or sectionalized flooring construction of FIG. 1.

Sectionalized flooring system 100 is assembled from a plurality of separate floor sections or panels falling into either of two size groups having respectively different lengths. The first group consists of large panels or sections 102 while the second group is made up of small panels or sections 104. For purposes of panel fabrication and subsequent floor assembly at the site, the large sections 102 are preferably 4 feet ×8 feet while the small sections are preferably 4 feet ×4 feet. As may be easily appreciated from the plan view of the panels shown in FIG. 1, by appropriately positioning large and small sections 102 and 104 in the rows of the flooring area 100, the joints between the ends of the longitudinally aligned sections can effectively be staggered between adjacent rows. Such flooring construction including panel-to-panel connectors, is described in detail in U.S. Pat. No. 4,538,392 to which the description therein is hereby incorporated herein. Obviously, anchor assembly 200 may be used with portable sectionalized flooring having different dimensions, markings, construction or other different structural characteristics than the flooring described above.

Figure 4:
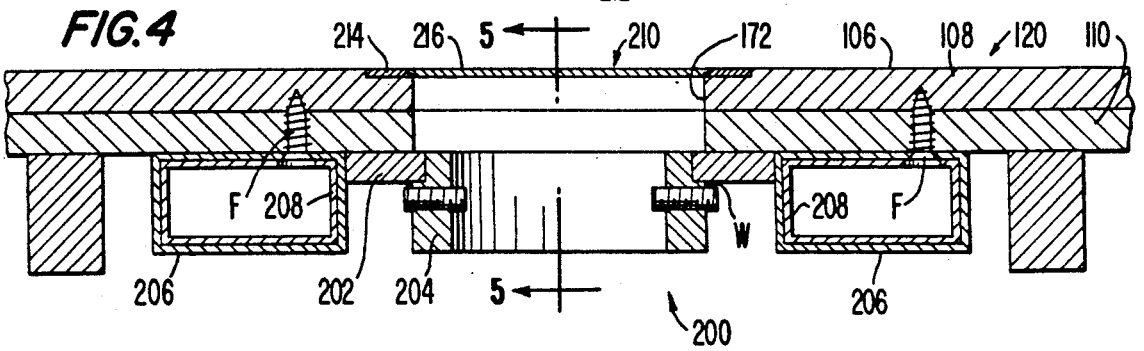
FIG. 4 is a cross-sectional view of the post anchor assembly secured to the undersurface of a floor panel taken along line 4—4 of FIG. 3.

FIG. 4 illustrates anchor assembly 200 secured to a post receiving panel 170. The basic construction of each panel includes an upper flooring layer 108 and a lower flooring layer or layer of underlayment 110 which together form a substantially planar member. Upper flooring 108 defines a flooring surface 106, while underlayment 110 defines the panel undersurface (not designate). Each panel also includes a plurality of spaced elevation members 112 which extend transversely along and attached to the panel undersurface for supporting layers 108 and 110 above a base surface.

Figure 3:
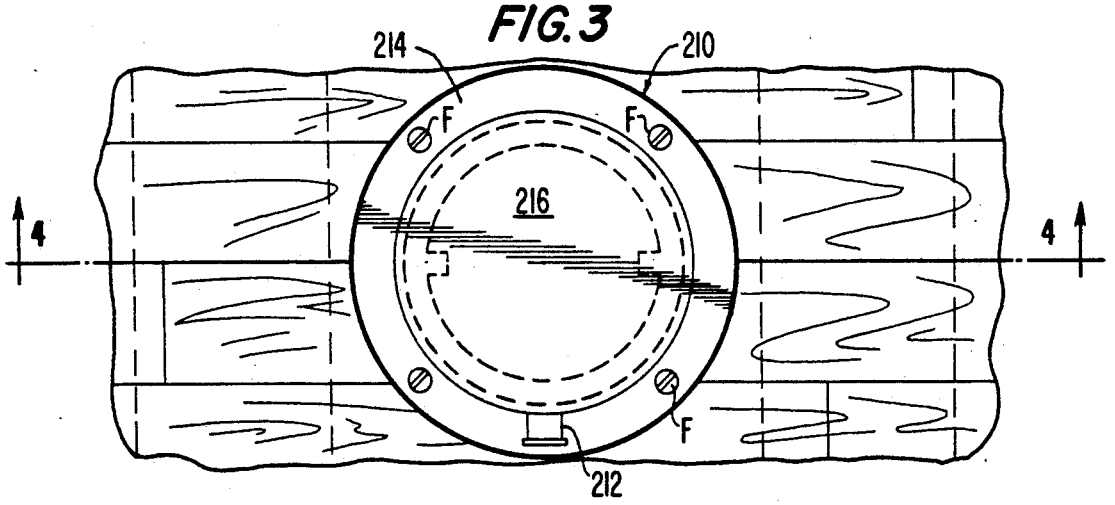
FIG. 3 is an enlarged plan view of the post anchor assembly and post hole cover therefore from the upper surface of a panel.
Figure 5:
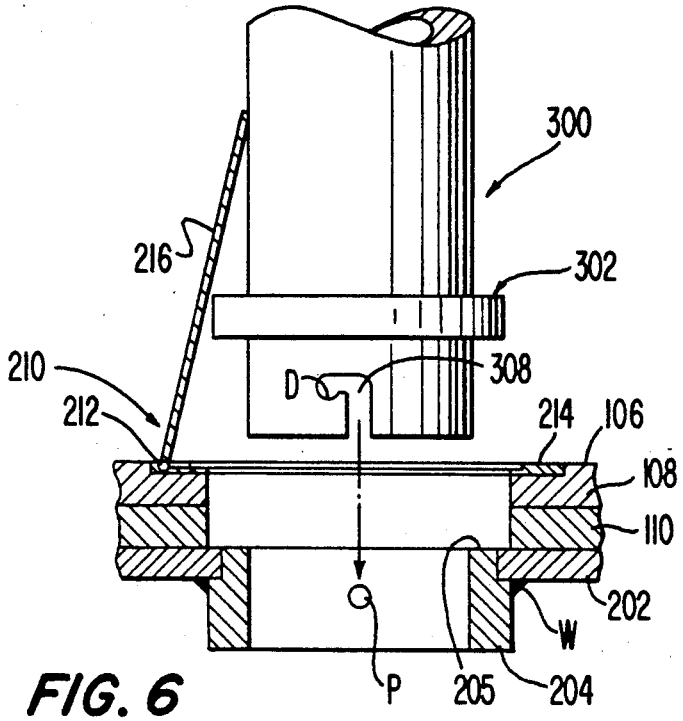
FIG. 5 is a cross-sectional view of a portion of the post anchor assembly taken along line 5—5 of FIG. 4 and further including the post ready to be inserted.
Figure 6:
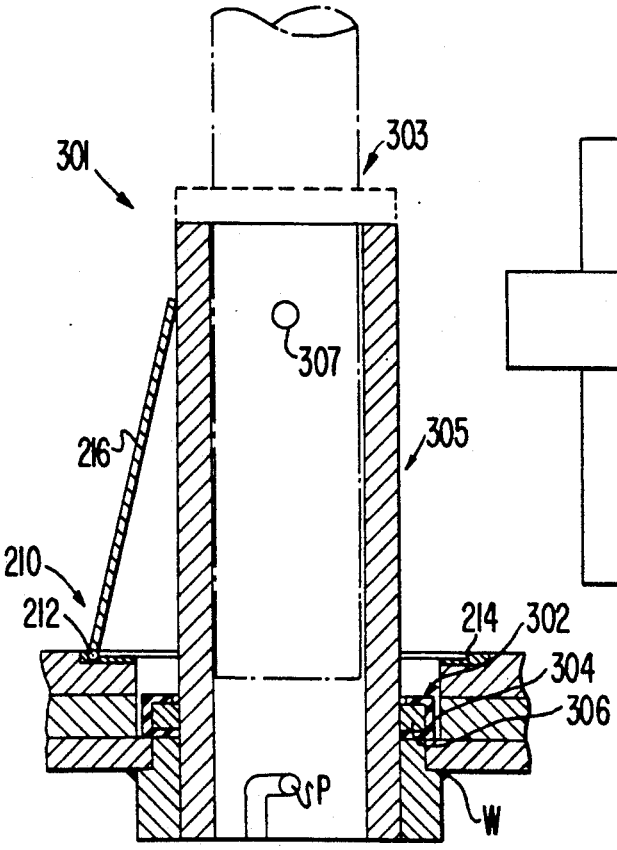
FIG. 6 is a cross-sectional view of the post anchor assembly of FIG. 5 with a further post embodiment having a second portion shown in phantom connected to the post anchor.

Post receiving panel 170 further includes post receiving hole 172 and cover plate 210 therefore. In the closed position, cover plate 210 is flush with floor surface 106. FIGS. 3 and 4 may be referred to as illustrating cover plate 210 closed from a top planar and cross-sectional view, respectively. FIGS. 5 and 6 show cover plate 210 in an open position from a cross-sectional view. Referring to FIG. 3, cover plate 210 includes lid 216 pivotally mounted to flat ring 214 by hinge 212. Flat ring 214 is received in a ring shape groove in upper surface 106 and secured to panel 170 by fasteners F.

Returning to FIG. 4, post anchor base assembly 200 includes a support plate 202 having a hole therethrough, a hollow tubular post support 204 inserted in the plate hole and secured to plate 202 by weld W or other suitable means, and two pieces of hollow rectangular tubing 206 each extending along the entire width of panel 170. Hollow rectangular tubing 206 is fixedly secured to support plate 202 along opposite edges thereof by suitable means. Tubing 206 is further secured to the undersurface of panel 170 by fasteners F, such as screws, so that the axis of tubular support plate 204 and the center of post panel post hole 172 are substantially aligned. As seen in FIG. 1, support plate 202 also is preferably secured to the undersurface of panel 170 by fasteners F. Referring to FIGS. 4 and 5, it can be seen that diametrically disposed pins P which extend radially into the bore of post support tube 204 are intended to engage with detents D provided in diametrically disposed bayonet type slots 308 of volleyball net post 300 and thereby connect post 300 to post anchor base assembly 200.

Figure 2:
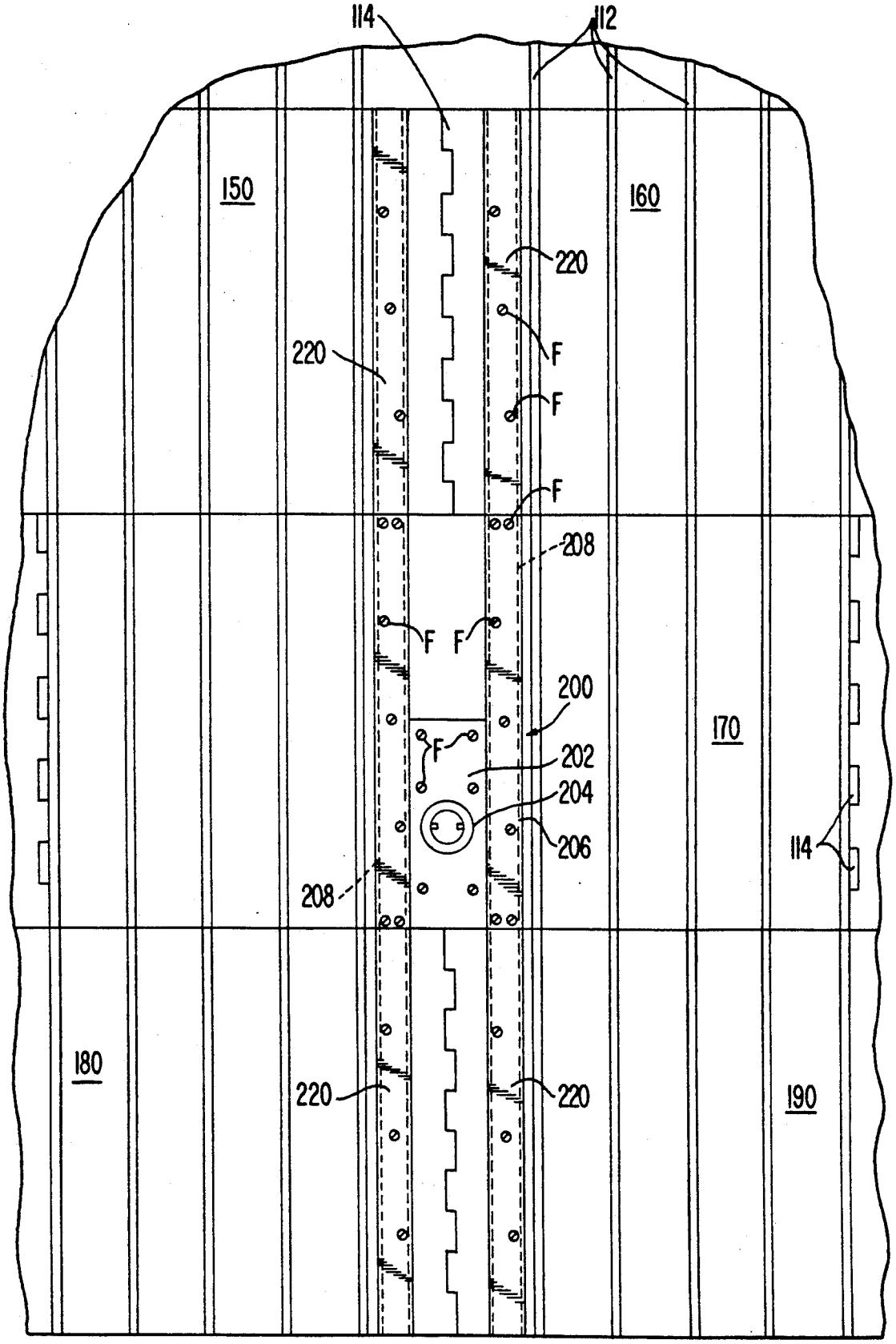
FIG. 2 is an enlarged plan view of the post anchor assembly secured to the undersurface of sectionalized flooring panels.

FIG. 2 shows the full span or anchor base assembly 200 fixedly secured to the underside of five floor panels arranged in three rows. The interlocking finger joint between the ends of panels 150 and 160, which are provided with projecting fingers 114, is aligned with the corresponding joint between panels 180 and 190. Obviously, the panel ends may be joined by other suitable means. These joints are staggered with respect to the ends of post receiving panel 170. Therefore, both rectangular tubing members 206 are fixedly secured to post receiving panel 170 while only one rectangular tubing extension 220 is fixedly secured to each remaining panel 150, 160, 180 and 190. After the rectangular tubing is fastened to respective panels by fasteners F, the panels are operatively associated, tubing members 206 for a first pair of tubes which aligns with second and third pairs of tubes formed by tubing extensions 220. A solid or hollow rectangular stiffening tube 208, having a length corresponding to approximately three panels widths, is inserted into each channel defined by rectangular tube 206 and one extension tube 220 at each end thereof. Thus, tube 208 not only connects or coupled, but stiffens, each group of three tubes which extend over three panel widths, thereby further stabilizing the orientation of tubular post support 204. Such construction enables the post when inserted into the post anchor base assembly to remain substantially in the upright position without the necessity of inserting or otherwise anchoring the post to the subfloor. That is, the construction of anchor assembly 200 results in a support base that extends over an area of three panel widths, and in the preferred embodiment, is connected to five panels. Such as anchor assembly readily absorbs moments placed on the post by a net.

Figure 7:
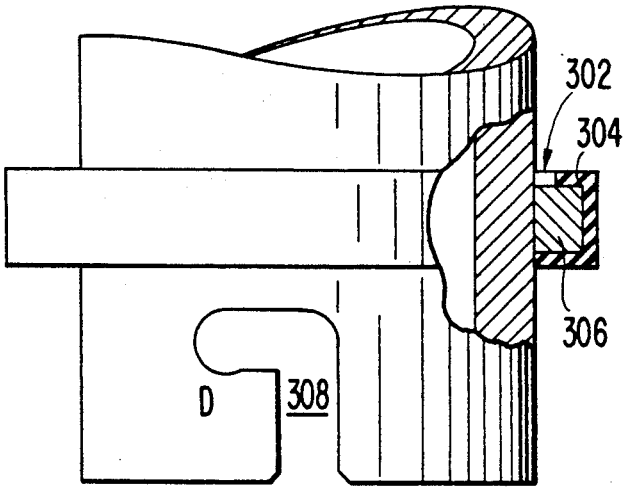
FIG. 7 is an enlarged view of the base of the post with a cross-sectional view of the abutment flange.

The association between the post and anchor base is best understood from FIGS. 5–7. Referring to FIG. 5, volleyball net post 300 has an annular flange 302 and diametrically disposed bayonet type slots 308. Flange 302 abuts with shelf 205 defined by an end surface of tubular post support 204 and thereby provides a vertical stop and support mechanism. Post receiving hole 172 thus has a first diameter and hollow cylinder 204 has a smaller inner diameter. Alternatively, flange 302 could abut with ring 214 if desired and appropriate dimensional changes made. Slot 308 cooperate with pines P to provide a bayonet fastening mechanism between the post and anchor assembly.

FIG. 7 shows the basic construction of flange 302. Substantially inelastic core 306 provides the necessary rigidity for supporting post 300. Resilient casing 304 which may be made from elastomeric materials encapsulates core 306 and develops a spring bias between pin P and detent D.

FIG. 6 depicts a further embodiment of the volleyball post. Posts 303 and 305 form post assembly 301. Post 305 is essentially the same as post 300 but substantially shorter. Securement means for fixing post 303 to post 305 may be advanced through opening 307.

The parts of post anchor base assembly 200 also form an apparatus or system for converting a existing portable sectionalized flooring system into a flooring system for use as a volleyball court or another type of floor requiring posts. The apparatus would include support plate 202, post support 204, and tubes 206, 220 and 208.

Obviously, the sizes and materials used in the components making up the post anchor base assembly may be selected from a wide variety of sizes and/or materials. Merely to exemplify a preferred makeup of these components the following example may be recited. Support plate 202 can be 9 inches by 22 inches with a ⅝ inch thickness. Rectangular tube 206 and tube extension 220 have similar dimensions. These tubes can be 2 inches ×4 inches with a 1/8 inch wall thickness and have an approximately 47 inch length. Each stiffening tube 208 would have approximately a 12 foot length to extend across three panel widths. Post support tube 204 should be appropriately dimensioned to receive and support a post 1 or a post adapter having a 3 to 5 inch outer diameter, depending on the type of post used. Support plate 202, tubes 206, 208 and 220, and post support tube 204 may be aluminum, a relatively lightweight metal, to improve portability. Post anchor hole cover 210 should be brass.

Having described a preferred embodiment in detail, it will be recognized that the foregoing is considered as illustrative only of the principles of the invention. Further, since numerous modifications and changes will readily occur to those skilled in the art, it is not desired to limit the invention to the exact construction, materials, assembly, etc. shown and described. Accordingly, all suitable modifications and equivalents may be resorted to the extent that they fall within the scope of the invention and claims appended hereto.

We claim:

1. A floor section having a built-in post anchor for use with a portable sectionalized flooring system suitable for a volleyball court or the like comprising:

a panel comprising a substantially planar member and a plurality of elevation members, said planar member having an upper surface and an undersurface, said plurality of elevation members supporting said planar member a distance above a base surface, said panel having a hole extending through it in a direction substantially normal to the planar upper surface;

a post anchor base assembly comprising a plate support member and a hollow cylinder extending from said support member, said base assembly being fixedly secured to said undersurface with said hollow cylinder in alignment with said panel hole for receiving and supporting post; and coupling means connected to said plate support member for coupling said base assembly and said panel secured thereto to at least one adjacent panel.

2. The floor section of claim 1 wherein said coupling means comprises a first hollow tube fixedly secured to one edge of said plate member and a second hollow tube fixedly secured to the plate member edge opposite said one edge, said first and second tubes extending along substantially the entire width of said panel and being fixedly secured to said panel.

3. The floor section of claim 2 wherein a coupling tube having a length greater than that of the first or second tube extends through each of the first and second tubes to provide means for coupling said floor section with adjacent floor sections having at least one tube fixedly secured to respective panels.

4. The floor section of claim 2 wherein each of said tubes is fixedly secured to the undersurface of the respective planar member.

5. The floor section of claim 2 wherein said hollow cylinder includes means for securing the post to said hollow cylinder.

6. The floor section of claim 5 wherein said securing means comprises at least one pine extending radially inwardly from an inner wall of said hollow cylinder.

7. The floor section of claim 6 wherein said securing means comprises two pins oppositely disposed and extending radially inwardly from an inner wall of said hollow cylinder.

8. The floor section of claim 6 further comprising a post extending from said hollow cylinder, said post having at least one generally L-shaped slot formed in its wall for removably connecting said post with said at least one pine, said slot having a first portion extending from one end of the post, generally in alignment with the longitudinal axis of the post, to a first region inwardly spaced from said post one end, said slot having a second portion extending from said first region to a second region circumferentially spaced from said first region, and said slot further extending from the second region toward the one end of the post thereby forming a detent.

9. The floor section of claim 8 wherein at least two of said slots are formed in the post wall and two of said pins extend from an inner wall of said hollow cylinder.

10. The floor section of claim 8 wherein said post further comprises an annular flange circumscribing the post and being spaced from the slot in a direction away from said one end of the post, said flange having a surface facing the one end of the post with a ring of resilient material to provide a spring bias between the pin and slot when the pin is received in the detent.

11. The floor section of claim 10 wherein the hole extending through the panel has a first diameter, a portion of said post anchor base assembly extending radially inward of said first diameter with said hollow cylinder having an inner diameter less than said first diameter, and said ring of elastic material engaging said radially inwardly extending portion of said base assembly.

12. The floor section of claim 1 further comprising a cover plate hingedly secured to said planar member upper surface adjacent said panel hole.

13. The floor section of claim 12 wherein said cover plate includes a ring attached to a ring shaped groove in said planar member upper surface surrounding said panel hole, and a center portion located inside of said ring and hingedly connected to said ring.

14. A floor section assembly having a built-in post anchor for use with a portable sectionalized flooring system suitable for a volleyball court or the like comprising:

a plurality of panels removably connected to one another to form the floor section assembly, each panel comprising a substantially planar member and a plurality of elevation members, said planar member having an upper surface and an undersurface, said plurality of elevation members supporting said planar members a distance above a base surface, one of said panels having a hole extending through it in a direction substantially normal to the upper surface of said one of the planar members; and a post anchor base assembly comprising a support member, a hollow cylinder extending from said support member and means for coupling said support member and hollow cylinder to at least one of said plurality of panels located on at least one side of said one of said panels, said coupling means being connected to said support member, said base assembly being fixedly secured below the undersurface of one of said plurality of panels and positioned on said one of the panels so that said cylinder aligns with said panel hole for receiving and supporting a post.

15. The floor section assembly of claim 14 wherein said coupling means comprises a plurality of hollow tubes, a first pair of said hollow tubes being fixedly secured to said support member so that said first pair of tubes are substantially parallel to one another, said first pair of tubes further being secured to said one of the panels, at least one second pair of the remaining hollow tubes being fixedly secured to at least one of the remaining plurality of panels, said first and second pairs of said hollow tubes aligning with one another when said panels are connected to form said floor section assembly, and an elongated rigid connecting member extending through aligned tubes of said first and second pairs.

16. The floor section assembly of claim 14 wherein said support member comprises a substantially flat plate member having a hole through it from which said hollow cylinder extends.

17. The floor section assembly of claim 14 wherein said hollow cylinder includes means for securing the post to said hollow cylinder.

18. The floor section assembly of claim 14 further comprising a cover plate hingedly secured to said planar member upper surface adjacent said panel hole.

19. The floor section assembly of claim 18 wherein said cover plate includes a ring attached to a ring shaped groove in said planar member upper surface surrounding said panel hole, and a center portion located inside of said ring and hingedly connected to said ring.

20. Apparatus for converting a portable sectionalized flooring system formed of a plurality of floor sections into a post supporting floor for a volleyball court or the like comprising:

a post anchor base assembly for attachment below an undersurface of a panel of one of the floor sections, said base assembly including a support member, a hollow cylinder extending from the support member for receiving and holding a post, and coupling means a portion of which is connected to said support member for coupling the one panel to at least one adjacent panel to transfer moment forces applied to said hollow cylinder by the post to at least one adjacent panel through said coupling means.

21. The apparatus of claim 20 wherein said coupling means couples the one panel to at least one panel on each of two opposite sides of one panel.

22. The apparatus of claim 20 or 21 wherein said coupling means includes a pair of hollow tubes for attachment to each of the panels to be in a manner to form aligned tubes between the panels coupled together with one pair of said hollow tubes connected to said support member, and a rigid member to extend between aligned hollow members.

23. Apparatus for converting a portable sectionalized flooring system formed of a plurality of floor sections into a post supporting floor for a volleyball court or the like comprising:

a support member and a hollow cylinder extending from the support member to be attached below a panel of one of the floor sections for receiving and holding a post;

a first pair of tubes to be attached below the one panel and connected to said support member;

a second pair of tubes to be attached below at least one other panel adjacent the one panel in alignment with the first pair of tubes; and rigid members for extending through aligned tubes.

24. The apparatus of claim 23 including a third pair of tubes to be attached below at least one additional panel in alignment with the first and second pairs of tubes.

25. A floor section having a built-in post anchor for use with a portable sectionalized flooring system suitable for a volleyball court of the like comprising:

a panel comprising a substantially planar member and a plurality of elevation members, said planar member having an upper surface and an undersurface, said plurality of elevation members supporting said planar member a distance above a base surface, said panel having a hole extending through it in a direction substantially normal to the planar upper surface; and a post anchor base assembly comprising a support member and a hollow cylinder extending from said support member, said support member comprising a substantially flat plate member having a hole extending through it, said hollow cylinder extending from the hole in said flat plate member and being attached to said flat member plate, said base assembly further comprising a first hollow tube fixedly secured to one edge of said plate member and a second hollow tube fixedly secured to the plate member edge opposite said one edge, said first and second tubes extending along substantially the entire width of said panel and being fixedly secured to said panel, said base assembly being fixedly secured to said undersurface with said hollow cylinder in alignment with said panel hole for receiving and supporting a post.

26. A floor section assembly having a built-in post anchor for use with a portable sectionalized flooring system suitable for a volleyball court or the like comprising:

a plurality of panels removably connected to one another to form the floor section assembly, each panel comprising a substantially planar member and a plurality of elevation members, said planar member having an upper surface and an undersurface, said plurality of elevation members supporting said planar members a distance above a base surface, one of said panels having a hole extending through it in a direction substantially normal to the upper surface of said one of the planar members; and a post anchor base assembly comprising a support member, a hollow cylinder extending from said support member and means for coupling said support member and hollow cylinder to at least one of said plurality of panels located on at least one side of said one of said panels, said base assembly being fixedly secured below the undersurface of one of said plurality of panels and positioned on said one of the panels so that said cylinder aligns with said panel hole for receiving and supporting a post, said coupling means comprising a plurality of hollow tubes, a first pair of said hollow tubes being fixedly secured to said support member so that said hollow tubes are fixedly secured to said support member and said first pair of tubes are substantially parallel to one another, said first pair of tubes further being secured to said one of the panels, a second pair of the remaining hollow tubes being fixedly secured to at least one of the remaining plurality of panels, a third pair of said hollow tubes fixedly secured to at least one other of the remaining plurality of panels, said first, second and third pairs of hollow tubes aligning with one another when said panels are connected to form said floor section assembly, and an elongated rigid connecting member extending through aligned tubes of said first, second and third pairs.

27. The floor section assembly of claim 26 wherein said second pair of hollow tubes are secured to at least one panel located to one side of the panel to which said first pair of hollow tubes is secured, and said third pair of hollow tubes is secured to at least one panel located to the opposite side of the panel to which said first pair of hollow tubes is secured.

28. The floor section assembly of claim 27 wherein each hollow tube of said second and third pair of hollow tubes is fixed to separate one of said panels whereby said post anchor base assembly is coupled to five panels.

29. A floor section assembly having a built-in post anchor for use with a portable sectionalized flooring system suitable for a volleyball court of the like comprising:

a plurality of panels removably connected to one another to form the floor section assembly, each panel comprising a substantially planar member and a plurality of elevation members, said planar member having an upper surface and an undersurface, said plurality of elevation members supporting said planar members a distance above a base surface, one of said panels having a hole extending through it in a direction substantially normal to the upper surface of said one of the planar members;

a post anchor base assembly comprising a support member, a hollow cylinder extending from said support member and means for coupling said support member and hollow cylinder to at least one of said plurality of panels located on at least one side of said one of said panels, at least one pin extending radially inwardly from an inner wall of said cylinder, said base assembly being fixedly secured below the undersurface of one of said plurality of panels and positioned on said one of the panels so that said cylinder aligns with said panel hole for receiving and supporting a post; and a post extending from said hollow cylinder, said post having at least one generally L-shaped slot formed in its walls for removably connecting said post with said at least one pin, said slot having a first portion extending from one end of the post, generally in alignment with the longitudinal axis of the post, to a first region inwardly spaced from said post one end, said slot having a second portion extending from said first region to a second region circumferentially spaced from said first region, and said slot further extending from the second region toward the one end of the post thereby forming a detent, an annular flange circumscribing the post and being spaced from the slot in a direction away from said one end of the post, said flange having a surface facing the one end of the post with a ring of resilient material to provide a spring bias between the pin and slot when the pin is received in the detent.

30. The floor section assembly of claim 29 wherein said securing means comprises two pins oppositely disposed and extending radially inwardly from an inner wall of said cylinder.

31. The floor section assembly of claim 29 wherein at least two of said slots are formed in the post wall and two of said pins extend from an inner wall of said hollow cylinder.

32. The floor section assembly of claim 29 wherein the hole extending through the panel has a first diameter, a portion of said post anchor base assembly extending radially inward of said first diameter with said hollow cylinder having an inner diameter less than said first diameter, and said ring of elastic material engaging said radially inwardly extending portion of said base assembly.

* * * * *